US005215853A

United States Patent [19]

Andrews et al.

[11] Patent Number: 5,215,853

[45] Date of Patent: Jun. 1, 1993

[54] PHOTOSENSITIVE IMAGING MEMBER AND PROCESS FOR MAKING SAME

[75] Inventors: John R. Andrews, Fairport; William G. Herbert, Williamson, both of N.Y.

[73] Assignee: Xerox Corporation, Stamford, Conn.

[21] Appl. No.: 812,591

[22] Filed: Dec. 23, 1991

[51] Int. Cl.[5] ..... G03G 5/14; G03G 5/047

[52] U.S. Cl. ..... 430/131; 430/127; 430/132; 430/133; 430/134; 205/76; 205/78; 427/126.3; 427/126.6

[58] Field of Search ..... 430/127, 131, 132, 133, 430/134

[56] References Cited

U.S. PATENT DOCUMENTS

| | | | |
|---|---|---|---|
| 3,844,906 | 10/1974 | Bailey et al. | 204/238 |
| 3,914,126 | 10/1975 | Pinsler | 430/131 X |
| 4,557,993 | 12/1985 | Matyjakowski | 430/131 |
| 4,588,667 | 5/1986 | Jones et al. | 430/73 |
| 4,618,552 | 10/1986 | Tanaka et al. | 430/60 |

*Primary Examiner*—Roland Martin

[57] ABSTRACT

A layered photosensitive imaging member is modified to reduce the effects of interference within the member caused by reflections from coherent light incident on a base ground plane. The modification described is to form the ground plane surface by an electroforming process which leaves the surface with a black finish. Light incident on the ground plane is absorbed, eliminating the reflections which contribute to the interference effect at the imaging member surface.

6 Claims, 2 Drawing Sheets

PHOTOSENSITIVE IMAGING MEMBER AND PROCESS FOR MAKING SAME

BACKGROUND AND MATERIAL DISCLOSURE STATEMENT

The present invention relates to an imaging system using coherent light radiation to expose a layered member in an image configuration and, more particularly, to a method for forming the imaging member so as to reduce optical interference occurring within said member which results in a plywooding type of defect in output prints.

There are numerous applications in the electrophotographic art wherein a coherent beam of radiation, typically from a helium-neon or diode laser, is modulated by an input image data signal. The modulated beam is directed (scanned) across the surface of a photosensitive medium. The medium can be, for example, a photoreceptor drum or belt in a xerographic printer, a photosensor CCD array, or a photosensitive film. Certain classes of photosensitive medium which can be characterized as "layered photoreceptors" have at least a partially transparent photosensitive layer overlying a conductive ground plane. A problem inherent in using these layered photoreceptors, depending upon the physical characteristics, is an interference effectively created by two dominant reflections of the incident coherent light on the surface of the photoreceptor; e.g. a first reflection from the top surface and a second reflection from the bottom surface of the relatively opaque conductive ground plane. This condition is shown in FIG. 1: a coherent beam is incident on a layered photoreceptor 6 comprising a charge transport layer 7, charge generator layer 8, and a ground plane 9. The interference effects can be explained by following two typical rays of the incident illumination. The two dominant reflections of a typical ray 1, are from the top surface of layer 7, ray A, and from the top surface of ground plane 9, ray C. The transmitted portion of ray C, ray E, combines with the reflected portion of ray 2, ray F, to form ray 3. Depending on the optical path difference as determined by the thickness and index of refraction of layer 7, the interference of rays E and F can be constructive or destructive when they combine to form ray 3. The transmitted portion of ray 2, ray G, combines with the reflected portion of ray C, ray D, and the interference of these two rays determines the light energy delivered to the generator layer 8. When the thickness is such that rays E and F undergo constructive interference, more light is reflected from the surface than average, and there will be destructive interference between rays D and G, delivering less light to generator layer 8 than the average illumination. when the transport layer 7 thickness is such that reflection is a minimum, the transmission into layer 8 will be a maximum. The thickness of practical transport layers varies by several wavelengths of light so that all possible interference conditions exist within a square inch of surface. This spatial variation in transmission of the top transparent layer 7 is equivalent to a spatial exposure variation of generator layer 8. This spatial exposure variation present in the image formed on the photoreceptor becomes manifest in the output copy derived from the exposed photoreceptor. The output copy exhibits a pattern of light and dark interference fringes which look like the grains on a sheet of plywood, hence the term "plywood effect" is generally applied to this problem.

In the prior art, various techniques are known for modifying the structure of the imaging member to reduce the second dominant reflection from the imaging member ground plane. U.S. Pat. No. 4,618,552 and copending application, U.S. Ser. No. 07/546,990, filed on Jul. 2, 1990 now U.S. Pat. No. 5,096,792, describe methods of roughening the surface of the ground plane to create a diffuse reflection of the light reflected therefrom. U.S. Ser. No. 07/541,655, filed on Jun. 21, 1990, now abandoned, discloses a roughening of the PET substrate upon which the ground plane is formed with the roughening replicated into the ground plane. U.S. Ser. No. 07/523,639, filed on May 15, 1990, now U.S. Pat. No. 5,051,328, and U.S. Ser. No. 07/552,200, filed on Jul. 13, 1990, now U.S. Pat. No. 5,139,907 disclose forming the ground plane or a layer over the ground plane, respectively, of a transparent conductive material. U.S. Ser. No. 07/646,117, filed on Jan. 28, 1991, now U.S. Pat. No. 5,069,758, discloses an electroforming process for the imaging member ground plane, which results in a ground plane with a smooth, dull surface.

The present invention is directed towards eliminating the reflections from the ground plane by forming the imaging member with a conductive ground plane with a black nickel surface. The black surface absorbs, rather than reflects, the incident light. Since the light absorbs, secondary reflections which create cross-talk among pixels at the member surface are eliminated. This eliminates a problem which was present in prior art systems which taught methods of diffusely reflecting light from the ground plane surface. Also present in the diffusely reflecting prior art concepts, for each wavelength of incident light, there was an optimum roughness to the diffusely reflecting surface. The black belt of the present invention absorbs all wavelengths; hence enabling a wider manufacturing latitude. More particularly, the present invention is directed towards an improved photosensitive imaging member having at least a conductive ground plane with an overlying charge transport and charge generator layers, the improvement wherein said ground plane has a smooth black finish which absorbs all wavelengths of light incident thereon.

DESCRIPTION OF THE INVENTION

Figure 1:
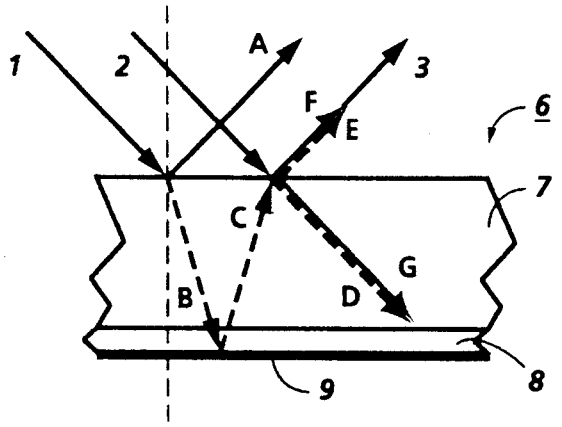
FIG. 1 PRIOR ART
FIG. 1 shows coherent light incident upon a prior art layered photosensitive medium leading to reflections internal to the medium.
Figure 2:
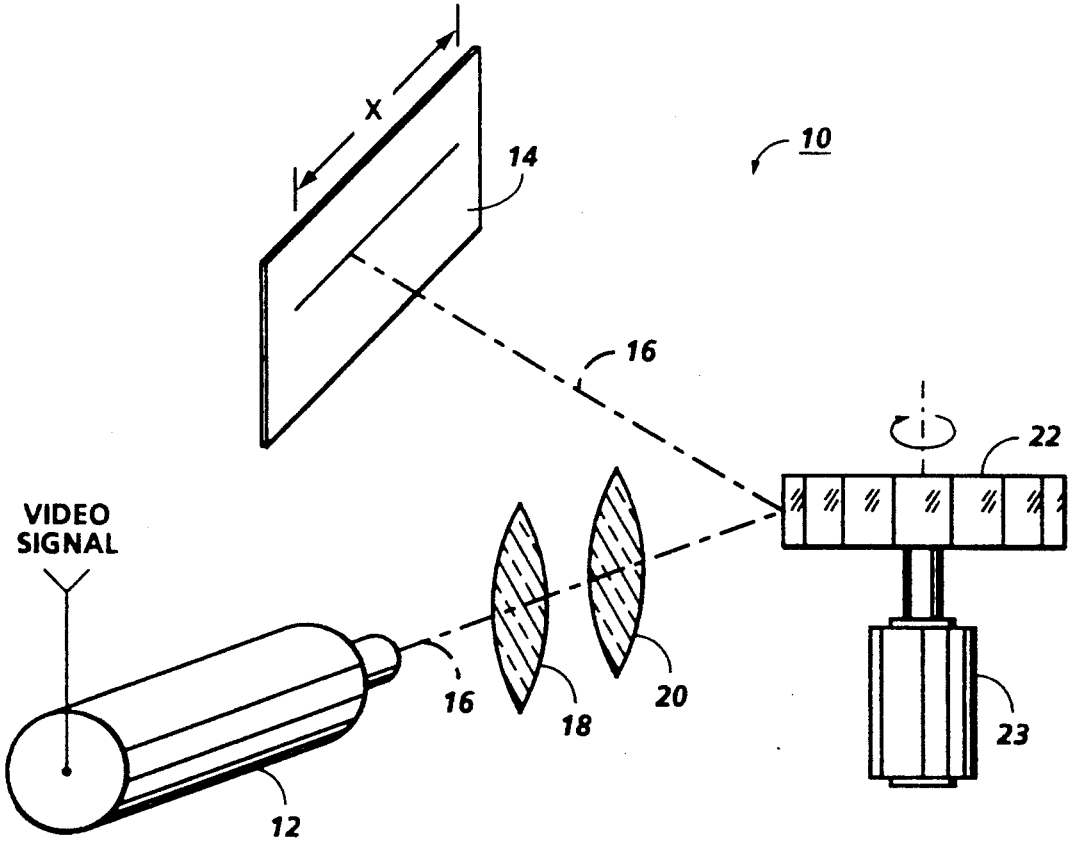
FIG. 2 is a schematic representation of an optical system incorporating a coherent light source to scan a light beam across a photoreceptor modified to reduce the interference effect according to the present invention.
Figure 3:
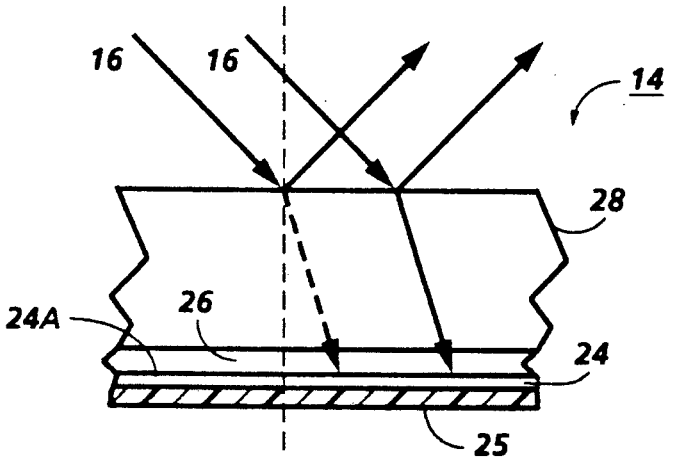
FIG. 3 shows a cross-sectional view of the photoreceptor of FIG. 2.

FIG. 2 shows an imaging system 10 wherein a laser 12 produces a coherent output which is scanned across photoreceptor 14. FIG. 3 is a cross sectional view of the photoreceptor of FIG. 2. Laser 12 is, for this embodiment, a helium neon laser with a characteristic wavelength of 0.63 micrometer, but may be, for example, an Al Ga As Laser diode with a characteristic wavelength of 0.78 micrometers. In response to video signal information representing the information to be printed or copied, the laser is driven in order to provide a modulated light output beam 16. The laser output, whether gas or laser diode, comprises light which is polarized parallel to the plane of incidence. Either polarization is possible and may be used depending on circumstances. Flat field collector and objective lens 18 and 20, respectively, are positioned in the optical path between laser 12 and light beam reflecting scanning device 22. In a preferred embodiment, device 22 is a multifaceted mirror polygon driven by motor 23, as shown. Flat field collector lens 18 collimates the diverging light beam 16 and field objective lens 20 causes the collected beam to be focused onto photoreceptor 14, after reflection from polygon 22. Photoreceptor 14 is a layered photoreceptor, but one which, in the prior art, has the structure shown in FIG. 3 and has been modified according to the invention shown in FIG. 4.

Referring to FIG. 3, photoreceptor 14 is a layered photoreceptor which includes a conductive ground plane 24 having a black surface 24A and formed by an electroforming process according to the present invention. The photoreceptor also includes a dielectric substrate 25, (typically polyethylene terephthalate (PET)), a charge generating layer 26, and a semitransparent charge transport layer 28. A blocking layer (not shown) is provided at the interface of ground plane 24 and charge generating layer 26 to trap charge carriers. A photoreceptor of this type (with a conventional ground plane 24) is disclosed in U.S. Pat. No. 4,588,667, whose contents are hereby incorporated by reference. The black surface 24A absorbs the light rays 16 penetrating through layers 28 and 26, thus eliminating the secondary reflections which create the interference pattern at the member surface.

Ground plane 24 is formed by an electroforming process in which a conventional electroforming technique, such as disclosed in U.S. Pat. No. 3,844,906, whose contents are hereby incorporated by reference, is modified in order to control the forming conditions, to create a surface having a black finish. In a preferred embodiment, ground plane 24 is an electroconductive (nickel) flexible seamless belt. The belt is electrodeposited on a cylindrically shaped form or mandrel which is suspended in an electrolytic bath (nickel sulfamate solution). A DC potential is applied between the rotating mandrel cathode and the donor metallic nickel anode for a sufficient period of time to effect electrodeposition of nickel on the mandrel to a predetermined thickness (0.0010 to 0.010 inch are typical thicknesses). Following formation of the belt substrate, the electroform is modified to make it slightly anodic (0.050 V to 0.450 V versus SCE) rather than the normal cathodic and a black surface oxide is formed. Thus, the black finish is advantageously formed in situ. Upon completion of the electroforming process, the mandrel and the nickel belt formed thereon are transferred to a cooling zone whereby the belt, which exhibits a different coefficient of thermal expansion than the mandrel, can be readily separated from the mandrel. The surface roughness of the belt is controlled to provide a surface smoothness (or roughness) of preferably 0.5 to 20.0$\mu$ inch RMS. The photosensitive layers (charge generating layer 26 and charge transport layer 28) are then deposited on ground plane 24 and substrate 25 using conventional techniques known in the art. The photoreceptor 14, when used, for example, in the ROS system shown in FIG. 3, exhibits virtually none of the spectral exposure variations which would otherwise have been caused by reflection from the ground plane since the light reaching the ground plane is absorbed by the black oxide finish.

The following examples are provided for forming a ground plane with a black surface. In a first example, a nickel substrate is formed with the following constituents and operating parameters:

EXAMPLE 1

Nickel Substrate

Major Electrolyte Constituents:
Nickel Sulfamate—as $Ni^{+2}$, 11 oz/gal. (82.5 g/L.)
Chloride—as $NiCl_2.6H_2O$, 2 oz/gal. (15 g/L.)
Boric Acid—5 oz/gal. (37.5 g/L.)
pH—3.95-4.05 at 23° C.
Surface Tension—at 136° F., 32-37 d/cm using Sodium Lauryl Sulfate (about 0.00525 g/L.).
Sacchrin—25-30 mg/L., as Sodium Benzosulfimide dihydrate
Impurities:
Azodisulfonate—5-10 mg/L.
Copper—5 mg/L.
Iron—25 mg/L.
MBSA—(2-Methyl Benzene Sulfonamide)-5-10 mg/L.
Sodium—1 gm/L.
Sulfate—5 g/L.
Operating Parameters:
Agitation rate—5 Linear ft/sec solution flow over the cathode surface.
Cathode (Mandrel)—Current Density, 225 ASF (amps per square foot)
Ramp Rise—0 to operating amps in 2 sec. ±1 sec.
Anode—Sulfur Depolarized Nickel and Carbonyl Nickel
Anode to Cathode Ratio—1.2:1
Deposit Thickness—0.0045 inches
Mandrel—Chromium plated Aluminum—8 to 15 micro inch RMS.
Temperature—62° C.

After the required thickness is obtained, the electroform is made slightly anodic (0.220 V. vs. a SCE for 30 seconds) and a black oxide is formed in situ. Other nickel electroforming conditions will often require a different anodic voltage to obtain the desired uniformly colored black finish.

EXAMPLE 2

Alternatively, the electroform can be removed from the system above or from other electroforming systems (which are well known those skilled in the art) before the anodic treatment and be subsequently made to have a black nonreflective surface by using a black nickel bath with the following constituents:

Major Electrolyte Constituents:
Nickel sulfate 75 g/L.
Nickel ammonium sulfate 45 g/L.
Zinc sulfate 37.5 g/L.
Sodium thiocyanate 15 g/L.
Room temperature
pH 5.6-5.9
Current density 0.5-2.0 amp/ft 2

EXAMPLE 3

A nickel substrate is formed as in Example 1. A black oxide finish is formed in a new bath, with the following constituents:
Nickel chloride 75 g/L.

Ammonium chloride 30 g/L.
Sodium thiocyanate 15 g/L.
Zinc chloride 30 g/L.
Room temperature
pH 5.0
Current density 1.5 amp/ft 2

Various other metals could be used instead of nickel: e.g. brass or copper. An aluminum substrate with a black surface could be formed by an anodization process. A black chromium surfaced belt can be obtained by forming a substrate, then exposing that substrate to a black chromium bath. Two examples are provided as shown in Examples 4 and 5.

EXAMPLE 4

Chromic acid 248–300 g/L.
Acetic acid 212 g/L.
Barium acetate 7.5 g/L.
Temperature 90°–115° F.
Current density 40–90 amp/ft 2

EXAMPLE 5

Chromic acid 248 g/L.
Fluosilic acid 0.25 g/L.
Temperature 80°–95° F.
Current density 150–450 amp/ft 2

While the invention has been described with reference to the structure disclosed, it will be appreciated that numerous changes and modifications are likely to occur to those skilled in the art, and it is intended to cover all changes and modifications which fall within the true spirit and scope of the invention.

What is claimed is:

1. A process for forming a photosensitive imaging member having at least a conductive ground plane substrate with overlying charge transport and charge generator layers comprising the steps of:

establishing and maintaining a continuous and stable aqueous electroforming solution containing an anode of a metal from the group comprising nickel, brass or copper, said solution further containing a support mandrel cathode, electrolytically forming a substrate of said metal on the surface of the support mandrel, forming a black oxide finish on the surface of said substrate, cooling said mandrel effecting a parting of the metal substrate from the mandrel due to different respective coefficients of thermal expansion, overlying said substrate with a charge generator layer, and overlying said charge generating layer with a charge transport layer.

2. The process of claim 1 wherein the ground plane substrate is nickel, and wherein the black oxide finish is formed by removing the mandrel with the substrate deposited thereon and placing the mandrel in a bath with the following constituents:

Nickel sulfate 75 g/L.
Nickel ammonium sulfate 45 g/L.
Zinc sulfate 37.5 g/L.
Sodium thiocyanate 15 g/L.
Room temperature
pH 5.6–5.9
Current density 0.5–2.0 amp/ft 2.

3. The process of claim 1 wherein the ground plane substrate is nickel and wherein the black oxide finish is formed by removing the mandrel with the substrate deposited thereon and placing the mandrel in a bath with the following constituents:

Nickel chloride 75 g/L.
Ammonium chloride 30 g/L.
Sodium thiocyanate 15 g/L.
Zinc chloride 30 g/L.
Room temperature
pH 5.0
Current density 1.5 amp/ft 2.

4. The process of claim 1 wherein the black oxide finish is formed by removing the mandrel with the substrate deposited thereon and placing the mandrel in a bath with the following constituents:

Chromic acid 248–300 g/L.
Acetic acid 212 g/L.
Barium acetate 7.5 g/L.
Temperature 90°–115° F.
Current density 40–90 amp/ft 2.

5. The process of claim 1 wherein said black oxide finish is formed by removing the mandrel with the substrate deposited thereon and placing the mandrel in a bath with the following constituents:

Chromic acid 248 g/L.
Fluosilic acid 0.25 g/L.
Temperature 80°–95° F.
Current density 150–450 amp/ft 2.

6. The process of claim 1 wherein said black oxide finish is formed in situ by making the electroform solution slightly anodic.

* * * * *